US007971515B2

(12) United States Patent
Garwood

(10) Patent No.: US 7,971,515 B2
(45) Date of Patent: Jul. 5, 2011

(54) ACCESS DOOR FOR FEEDER/DELINKER OF A GATLING GUN

(76) Inventor: Tracy W. Garwood, Scottsdale, AZ (US)

( * ) Notice: Subject to any disclaimer, the term of this patent is extended or adjusted under 35 U.S.C. 154(b) by 163 days.

(21) Appl. No.: 12/454,647

(22) Filed: May 21, 2009

(65) Prior Publication Data

US 2011/0120292 A1 May 26, 2011

Related U.S. Application Data

(63) Continuation-in-part of application No. 12/316,349, filed on Dec. 11, 2008.

(60) Provisional application No. 61/007,565, filed on Dec. 13, 2007.

(51) Int. Cl.
*F41F 1/10* (2006.01)

(52) U.S. Cl. ..... 89/12

(58) Field of Classification Search ..... 89/9, 12
See application file for complete search history.

(56) References Cited

U.S. PATENT DOCUMENTS 497,781 A * 5/1893 Gatling ..... 89/12
3,380,343 A * 4/1968 Chiabrandy et al. ..... 89/12
6,443,044 B1 * 9/2002 Dillon ..... 89/12

* cited by examiner

*Primary Examiner* — Stephen M Johnson
(74) *Attorney, Agent, or Firm* — Tod R. Nissle, P.C.

(57) ABSTRACT

A gatling gun construct increases operational life and reduces jams by utilizing in a feeder/delinker a feeder sprocket that engages the neck and shoulder of each cartridge. The gun also facilitates access to a feeder/delinker by utilizing a single access door that includes a plunger that maintains a cartridge in place in the feeder/delinker while the access door is opened and closed.

3 Claims, 15 Drawing Sheets

FIG. 1: Prior Art

FIG. 2: Prior Art

ACCESS DOOR FOR FEEDER/DELINKER OF A GATLING GUN

This application claims priority based on provisional patent application Ser. No. 61/007,565, filed Dec. 13, 2007, and is a continuation-in-part of non-provisional patent application Ser. No. 12/316,349, filed Dec. 11, 2008.

This invention relates to Gatling machine guns.

More particularly, the invention relates to an improved feeder/delinker in a Gatling machine gun.

In a further respect, the invention relates to application pertains to an improved access assembly for the feeder/delinker of a Gatling machine gun.

In another respect, the invention pertains to an improved light weight feeder sprocket for the feeder/delnker of a Gatling machine gun.

A long existing motivation in the design of Gatling machine guns is to minimize jams and extend the operational life of the guns. This motivation is tempered by the natural tendency of human beings to "leave things as they are" and by the long existence of the motivation. For example, the conventional feeder sprocket addressed by the invention has existed for decades without being altered. Similarly, the conventional two door access to the feeder/delinker of a Gatling gun has existed for nearly nine years without change, and the conventional cover that predated the two door access existed for decades prior to the advent of the two door access.

Accordingly, it would be highly desirable to provide an improved feeder/delinker for a Gatling machine gun.

Therefore it is a principal object of the invention to provide an improved access assembly and feeder sprocket for a Gatling machine gun.

These and other, further and more specific objects of the invention will be apparent to those skilled in the art from the following detailed description thereof, taken in conjunction with the drawings, in which.

Figure 1:
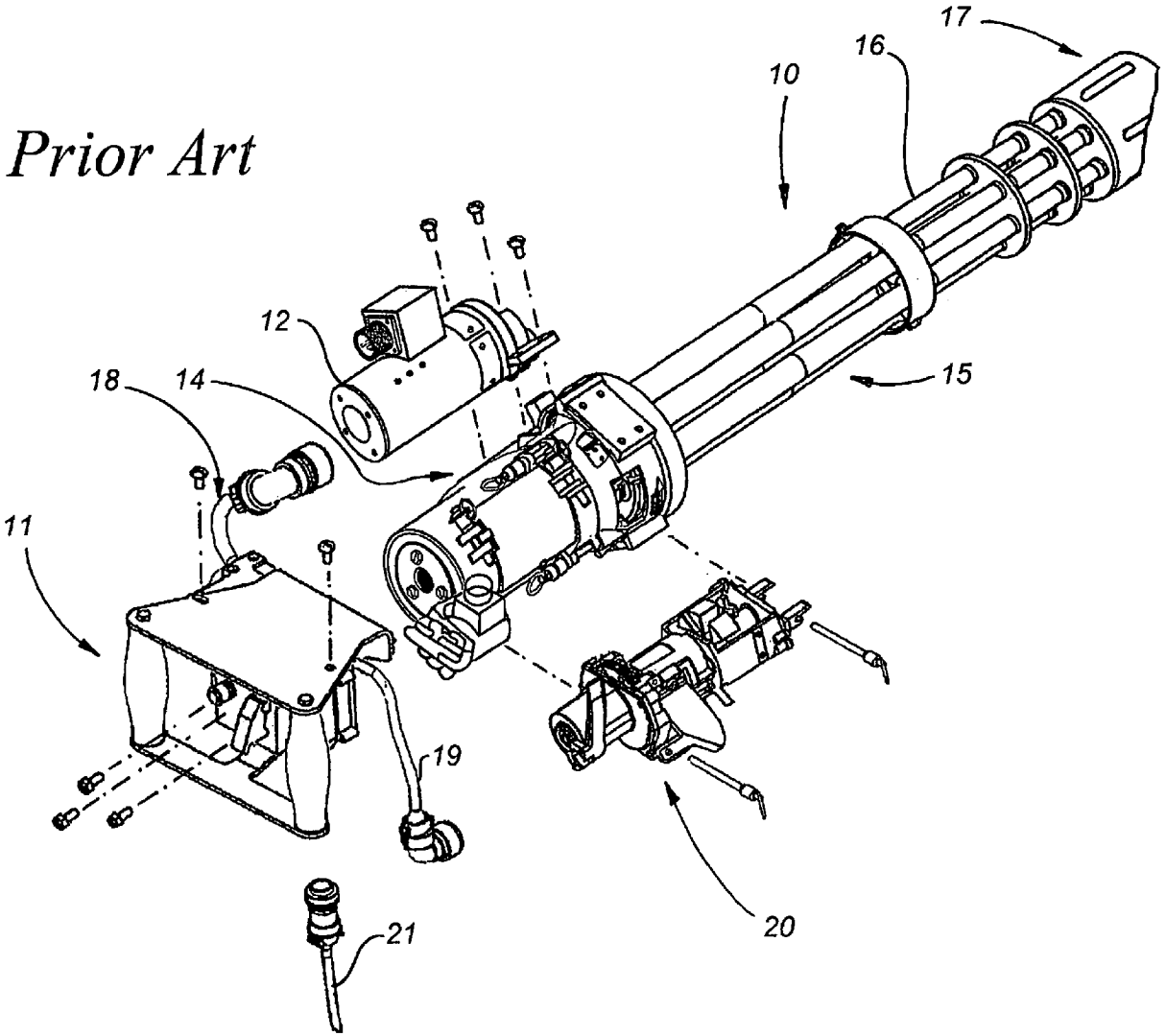
FIG. 1 is an exploded perspective view illustrating a Gatling gun known as a 7.62 minigun.

Briefly, in accordance with the invention, I provide an improved gatling gun. The gun includes a barrel assembly including a plurality of circumferentially mounted gun barrels; a motor to rotate the barrel assembly; and, a feeder/delinker to receive a belt of linked cartridges, separate cartridges from the belt, and feed the cartridges for firing. The feeder/delinker includes a feeder/delinker housing; a shaft mounted in the feeder/delinker housing; a drive gear mounted on the shaft, operatively associated with the motor, and rotationally coupled to the shaft and to the plurality of gun barrels; a push rod guide housing mounted in the feeder/delinker housing on the shaft and including a plurality of spaced apart, parallel, longitudinal guide slots each parallel to the gun barrels; a plurality of push rods each slidably mounted in one of the longitudinal guide slots in the push rod guide housing; a slide channel apparatus rotationally coupled to the drive gear to oscillate each of the plurality of push rods forwardly and rearwardly; a secondary cartridge holding construct mounted on the shaft forwardly of the push rod guide housing, and including a plurality of grooves each aligned with one of the guide slots in the push rod guide housing; a secondary cartridge stripping construct mounted on the shaft forwardly of the secondary cartridge holding construct, including a plurality of grooves each aligned with one of the guide slots in the push rod guide housing, and shaped and dimensioned to receive and prevent longitudinal movement of a cartridge link such that when a linked cartridge positioned in one of the holding constructed grooves, one of the stripping construct grooves is displaced longitudinally by an associated push rod, and the push rod is moved longitudinally by the slide channel apparatus, the stripping construct retains the cartridge link and permits the cartridge to be freed from the link; and, a feeder sprocket to receive cartridges from the stripper construct after the cartridges have been freed from cartridge links. The cartridges each include a casing, a tapered, conically shaped shoulder, and a tapered, conically shaped neck. The feeder sprocket includes a plurality of grooves each aligned with one of the guide slots in said push rod guide housing; shaped and dimensioned to slidably receive and dispense a cartridge; and including tapered guide surfaces contoured to conform substantially to at least a portion of each of the tapered, conically shaped shoulder, of the tapered, conically shaped neck, and of the casing. The gun also includes a single access door mounted on the feeder/delinker housing and movable between at least two operative positions, a first closed operative position, and a second open operative position. The access door includes a plunger to contact and secure a linked cartridge in the holding and stripping constructs when the access door is in the second open position. The plunger is movable between at least two operative positions, a first operative position with a portion of the plunger stored in the access door, and a second operative position with a portion of the plunger deployed from the access door.

In another embodiment of the invention, I provide an improved gatling gun. The gun includes a barrel assembly including a plurality of circumferentially mounted gun barrels; a motor to rotate the barrel assembly; and, a feeder/delinker to receive a belt of linked cartridges, separate cartridges from the belt, and feed the cartridges for firing. The feeder/delinker includes a feeder/delinker housing; a shaft mounted in the feeder/delinker housing; a drive gear mounted on the shaft, operatively associated with the motor, and rotationally coupled to the shaft and to the plurality of gun barrels; a push rod guide housing mounted in the feeder/delinker housing on the shaft and including a plurality of spaced apart, parallel, longitudinal guide slots each parallel to the gun barrels; a plurality of push rods each slidably mounted in one of the longitudinal guide slots in the push rod guide housing; a slide channel apparatus rotationally coupled to the drive gear to oscillate each of the plurality of push rods forwardly and rearwardly; a secondary cartridge holding construct mounted on the shaft forwardly of the push rod guide housing, and including a plurality of grooves each aligned with one of the guide slots in the push rod guide housing; a secondary cartridge stripping construct mounted on the shaft forwardly of the secondary cartridge holding construct, including a plurality of grooves each aligned with one of the guide slots in the push rod guide housing, and shaped and dimensioned to receive and prevent longitudinal movement of a cartridge link such that when a linked cartridge positioned in one of the holding constructed grooves, one of the stripping construct grooves is displaced longitudinally by an associated push rod, and the push rod is moved longitudinally by the slide channel apparatus, the stripping construct retains the cartridge link and permits the cartridge to be freed from the link; and, a feeder sprocket to receive cartridges from the stripper construct after the cartridges have been freed from cartridge links. The cartridges each include a casing, a tapered, conically shaped shoulder, and a tapered, conically shaped neck. The feeder sprocket includes a plurality of grooves each aligned with one of the guide slots in said push rod guide housing; shaped and dimensioned to slidably receive and dispense a cartridge; and including tapered guide surfaces contoured to conform substantially to at least a portion of each of the tapered, conically shaped shoulder, of the tapered, conically shaped neck, and of the casing.

In a further embodiment of the invention, I provide improved gatling gun. The gun includes a barrel assembly including a plurality of circumferentially mounted gun barrels; a motor to rotate the barrel assembly; and, a feeder/delinker to receive a belt of linked cartridges, separate cartridges from the belt, and feed the cartridges for firing. The feeder/delinker includes a feeder/delinker housing; a shaft mounted in the feeder/delinker housing; a drive gear mounted on the shaft, operatively associated with the motor, and rotationally coupled to the shaft and to the plurality of gun barrels; a push rod guide housing mounted in the feeder/delinker housing on the shaft and including a plurality of spaced apart, parallel, longitudinal guide slots each parallel to the gun barrels; a plurality of push rods each slidably mounted in one of the longitudinal guide slots in the push rod guide housing; a slide channel apparatus rotationally coupled to the drive gear to oscillate each of the plurality of push rods forwardly and rearwardly; a secondary cartridge holding construct mounted on the shaft forwardly of the push rod guide housing, and including a plurality of grooves each aligned with one of the guide slots in the push rod guide housing; a secondary cartridge stripping construct mounted on the shaft forwardly of the secondary cartridge holding construct, including a plurality of grooves each aligned with one of the guide slots in the push rod guide housing, and shaped and dimensioned to receive and prevent longitudinal movement of a cartridge link such that when a linked cartridge positioned in one of the holding constructed grooves, one of the stripping construct grooves is displaced longitudinally by an associated push rod, and the push rod is moved longitudinally by the slide channel apparatus, the stripping construct retains the cartridge link and permits the cartridge to be freed from the link; and, a feeder sprocket to receive cartridges from the stripper construct after the cartridges have been freed from cartridge links. The cartridges each include a casing, a tapered, conically shaped shoulder, and a tapered, conically shaped neck. The feeder sprocket includes a plurality of grooves each aligned with one of the guide slots in said push rod guide housing; shaped and dimensioned to slidably receive and dispense a cartridge. The gun also includes a single access door mounted on the feeder/delinker housing and movable between at least two operative positions, a first closed operative position, and a second open operative position. The access door includes a plunger to contact and secure a linked cartridge in the holding and stripping constructs when the access door is in the second open position. The plunger is movable between at least two operative positions, a first operative position with a portion of the plunger stored in the access door, and a second operative position with a portion of the plunger deployed from the access door.

Figure 2:
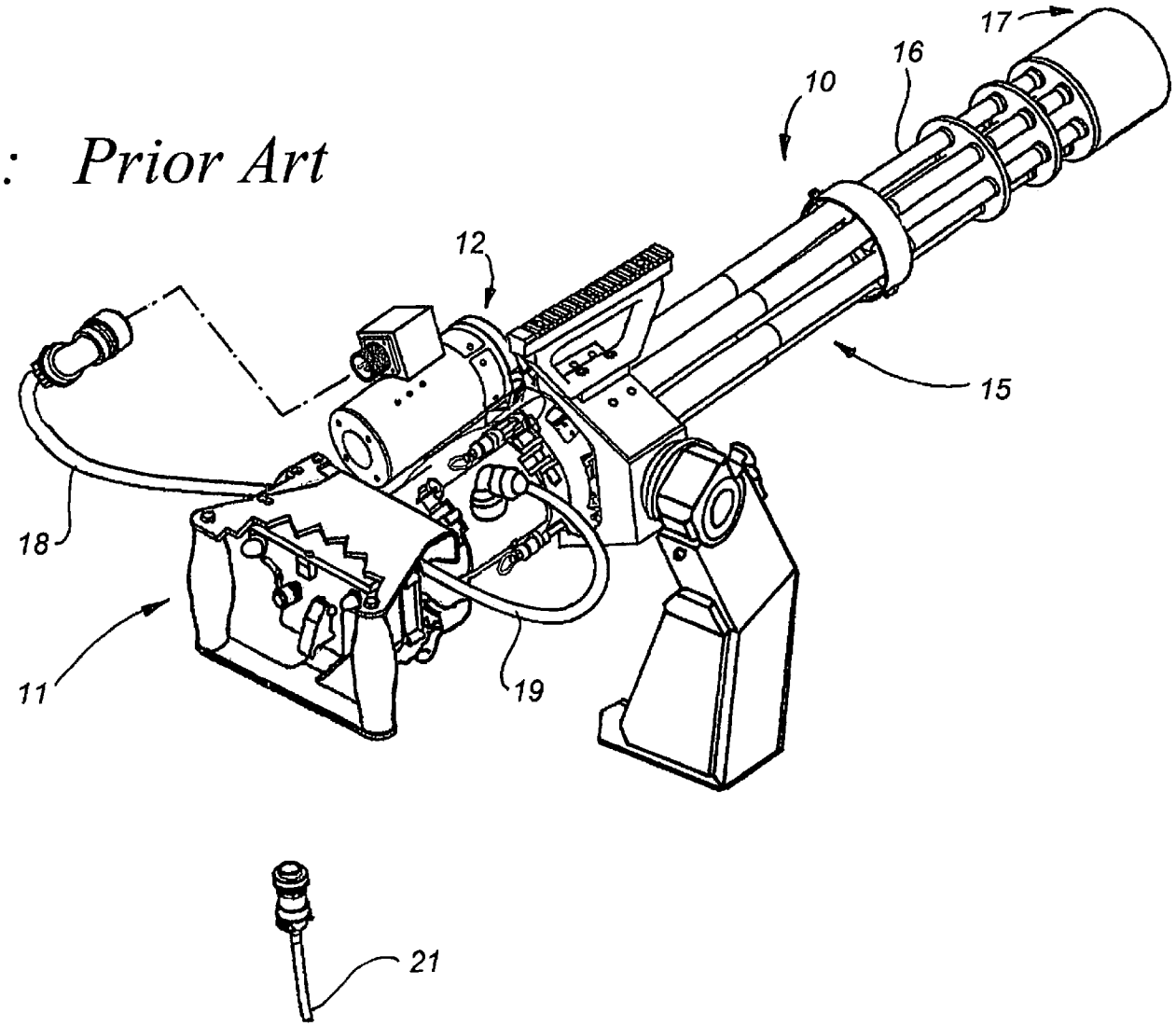
FIG. 2 is a perspective view illustrating the Gatling gun of FIG. 1 assembled.
Figure 3:
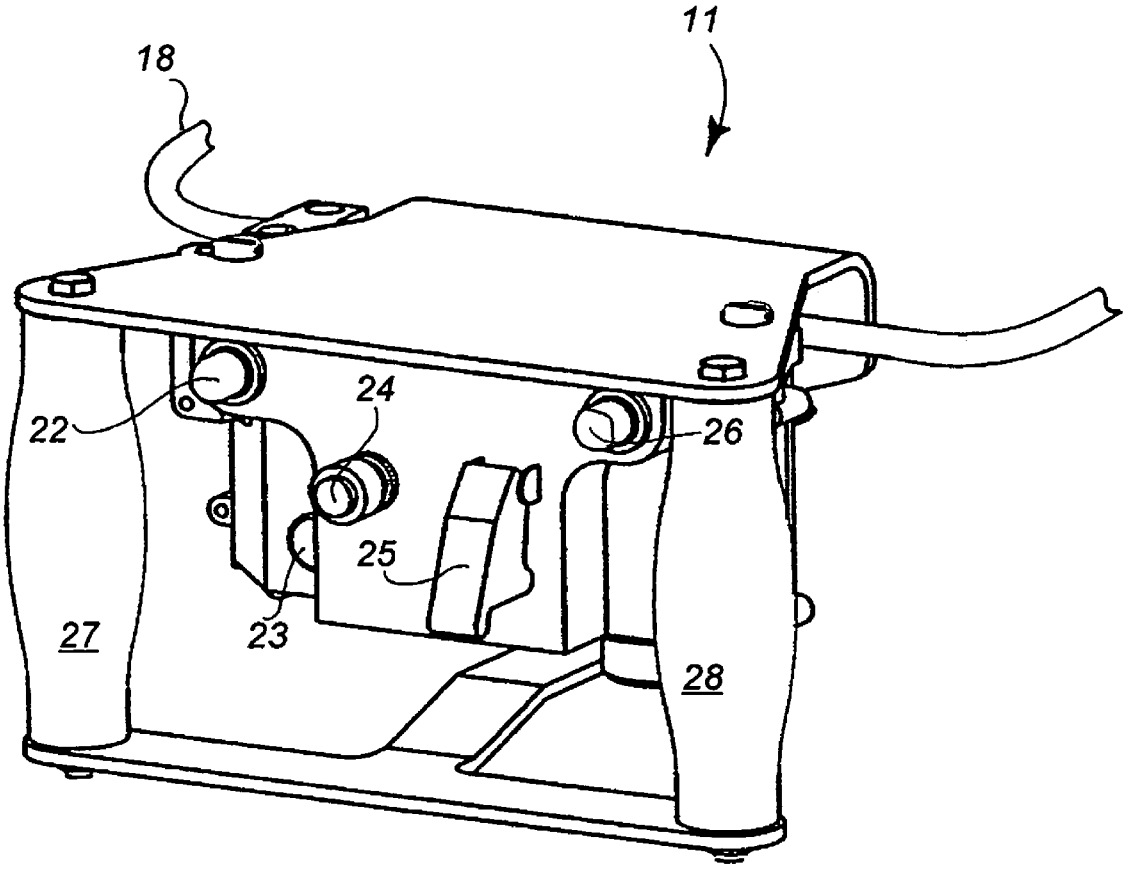
FIG. 3 Prior Art
FIG. 3 is a perspective view illustrating the control box of the Gatling gun of FIGS. 1 and 2.
Figure 4:
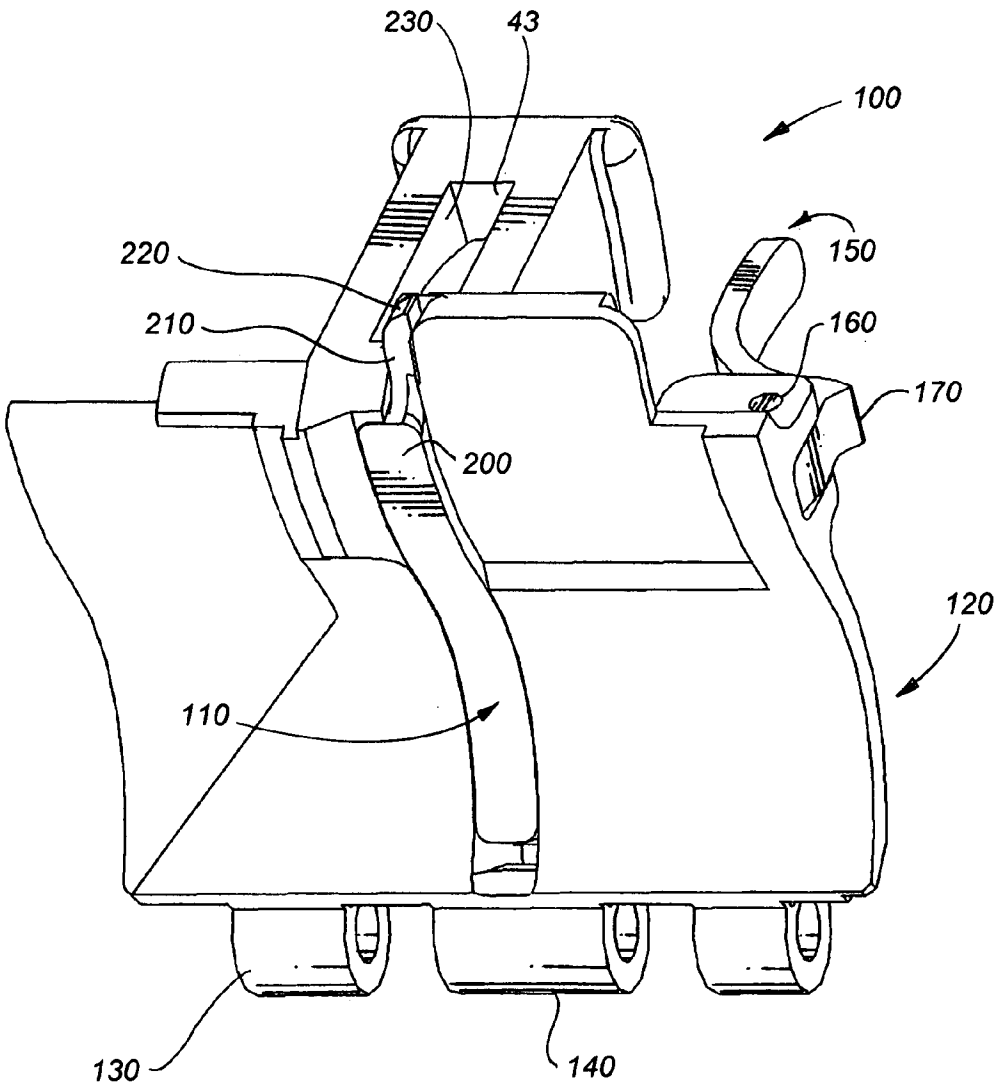
FIG. 4 is a bottom perspective view illustrating an access assembly constructed in accordance with the invention.

Turning now to the drawings, which depict the presently preferred embodiments of the invention for the purpose of illustration thereof, and not by way of limitation of the invention, and in which like characters refer to corresponding elements throughout the several views, FIGS. 1 to 3 illustrate a 7.62 "minigun" Gatling gun generally identified by reference character 10. Gun 10 includes barrel assembly 15, motor 12, feeder/delinker 20, clutch assembly 13, gun housing assembly 14, and control box 11. Barrel assembly 15 includes a plurality of circumferentially mounted barrels 16 and a flash suppressor 17. Ammunition is fired sequentially through barrels 16 in well known fashion, i.e., first one barrel is used, then the next, then the next, etc. Cable 21 supplies power to the control box 11. Cable 18 supplies power from the control box 11 to motor 12. The feeder/delinker is engaged and disengaged by cable 19.

As is well known, during operation of the Gatling gun 10, motor 12 causes the barrel assembly to rotate and each barrel 16 fires sequentially in rapid succession. During such operation, the feeder/delinker 20 receives a belt of linked ammunition. Feeder/delinker 20 functions to remove cartridges from the belt and sequentially feed the cartridges for firing.

Figure 17:
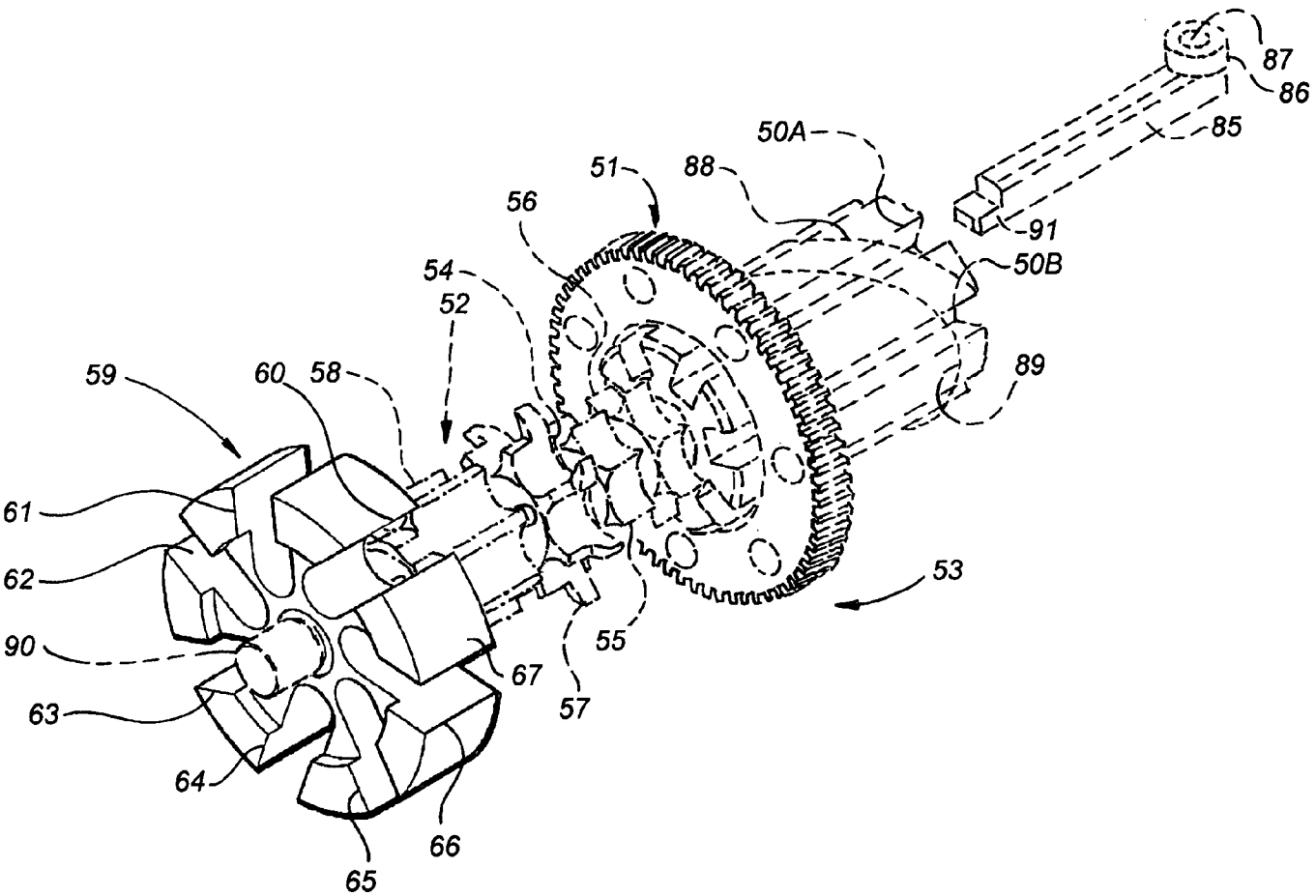
FIG. 17 PRIOR ART
FIG. 17 is a perspective view illustrating the interior and mode of operation of a prior art feeder/delinker; and, FIG. 18 is a perspective view illustrating an ammunition belt.

The internal guide assembly 53 found in the housing of a prior art feeder/delinker 20 is illustrated in FIG. 17. The housing is depicted and visible in FIG. 1. During operation of gun 10, assembly 53 continuously rotates to receive a belt of linked ammunition, to remove cartridges from the belt, and to feed the cartridges for firing.

Guide assembly 53 includes a shaft 90 and a series of components mounted on shaft 90. These components, from right to left in FIG. 17, include push rod guide housing 50, toothed drive gear 51, sprocket 56, sprocket 55, sprocket 54, sprocket 57, sprocket 58, and feeder sprocket 59. Each sprocket 54 to 59 includes seven equally spaced grooves. Each groove has a generally semi-cylindrical shape such that a cartridge casing can be received by the groove.

Seven equally spaced U-shaped longitudinal slots 50A are formed in housing 50 and are parallel to barrels 16. An arcuate outer surface 50B extends between each adjacent pair of slots 50A. Each groove in a sprocket 54 to 59 is aligned with one of slots 50A. Each slot 50A slidably receives a push rod 85. Each push rod 85 includes a wheel 86 rotatably mounted on an axle 87. Axle 87 is fixed and does not rotate. The wheel 86 of each push rod 85 is captured in and moved along a spiral slide channel indicated in FIG. 17 by dashed lines 88 and 89. Said spiral channel is formed in the housing of the feeder/delinker 20. When housing 50 rotates, each push rod wheel moves along said spiral channel and causes its push rod to slidably move back and forth in its associated slot 50A. When a push rod 85 moves forwardly in a direction of travel toward drive gear 51, the distal end 91 of the contacts the read of a cartridge 40 and pushes the cartridge 40 forwardly toward and into feeder sprocket 59. Driving the cartridge forwardly in this manner frees, or "delilnks", the cartridge from the ammunition belt.

Sprockets 55 and 56 comprise a secondary cartridge holding construct. The grooves in sprockets 55 and 56 are designed to receive a portion of a cartridge 40.

Sprockets 54, 57 and 58 comprise a secondary cartridge stripping construct. These sprockets are designed to receive and prevent longitudinal movement of a cartridge link in a ammunition belt so that the cartridge can be pushed free of the link by a push rod 85. The stripping construct "holds" the cartridge link while the cartridge is pushed free. By a push rod 85.

Figure 12:
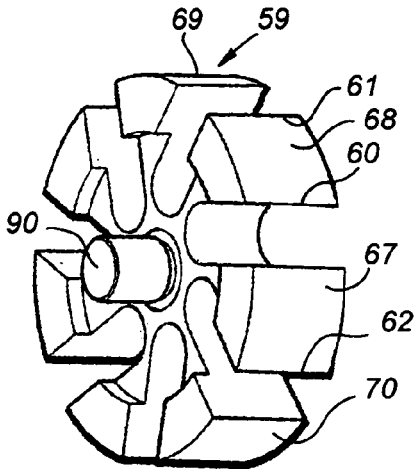
FIG. 12 PRIOR ART
FIG. 12 is a perspective view illustrating a conventional feeder/delinker feeder sprocket.
Figure 13:
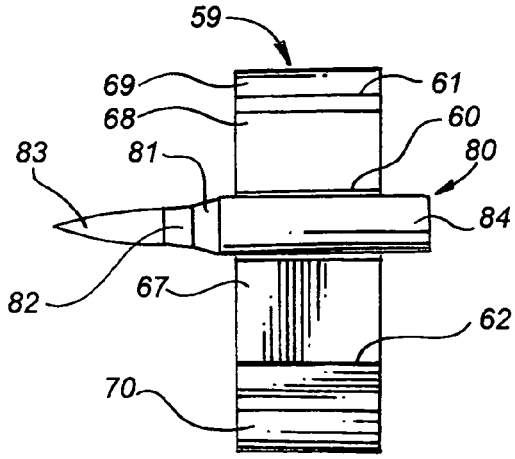
FIG. 13 PRIOR ART
FIG. 13 is a side view of the feeder/delinker feeder sprocket of FIG. 12 illustrating a cartridge supported in a slot formed therein.

The feeder sprocket 59 receives each cartridge 40 that is separated from an ammunition belt by a push rod 85, and then hands off the cartridge for firing. FIGS. 12, 13, and 17 illustrate a prior art feeder sprocket.

A cartridge 80 includes a cylindrical hollow casing 84 comprising the rear portion of cartridge 80. A primary conical tapered shoulder 81 extends from casing 84 to a conical tapered neck 82. Neck 82 extends from shoulder 81 to bullet 83. Accordingly, in FIG. 12 the rear (or right hand end in FIG. 12) of shoulder 81 is adjacent the front (or left hand end in FIG. 12) of casing 84. The front (or left hand end in FIG. 12) of shoulder 81 is adjacent the rear (or right hand end in FIG. 12) of neck 82. The front (or left hand end in FIG. 12) of neck 82 is adjacent bullet 83.

Figure 14:
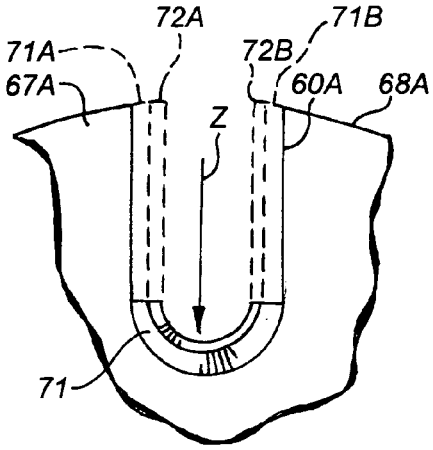
FIG. 14 is a rear view of the improved feeder/delinker feeder sprocket of the invention illustrating a slot formed therein.
Figure 15:
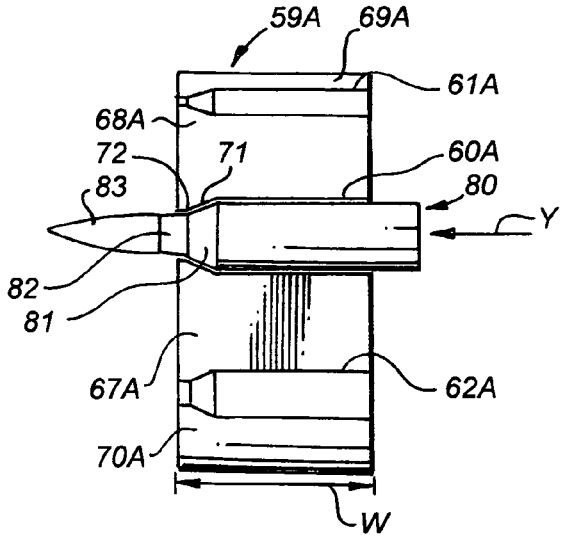
FIG. 15 is a side view of the improved feeder/delinker feeder sprocket of the invention illustrating a cartridge supported in a slot formed therein.

The light weight feeder sprocket 59A of the invention is depicted in FIGS. 14 and 15. Feeder sprocket 59A, as does sprocket 59, includes seven equally spaced grooves 60A. In contrast to the grooves 60 in sprocket 59, however, the grooves 60A include a first tapered semi-conical groove portion 71 that is shaped and dimensioned to contour to and contact a portion of the primary shoulder 81 of a cartridge 80, and includes a second tapered semi-conical groove portion 72 that is shaped and dimensioned to contour to and contact a portion of the neck 82 of a cartridge. A groove 60A is not contoured to and does not contact the bullet 83 in a cartridge 80. Bullet 83 is spaced away from and extends outwardly from groove 60A.

Semi-conical groove portion 71 extends approximately half way around shoulder 81. Semi-conical groove portion 72 extends approximately half way around neck 82.

Semi-conical groove portion 71 extends from the front of shoulder 81 to the rear of shoulder 81. The entire shoulder 81 is located in slot 60A during the time cartridge 80 is seated in feeder sprocket 59A.

In contrast, semi-conical groove portion 72 only extends from about the middle of neck 82 to the rear of neck 82, and, therefore, groove portion 72 only extends over a section of the back portion of neck 82. Consequently, the forward portion of neck 82 that extends from approximately the middle of neck 82 to the front of neck 82 is not located inside slot 60A of feeder sprocket 59A when cartridge 80 is seated in feeder sprocket 59A. Instead, the forward portion of neck 82 extends outwardly from feeder sprocket 59A in the manner illustrated in FIG. 15. This enables the forward portion of neck 82 to be contacted and controlled by a spiral guide or other guide in gun 10.

The width W of feeder sprocket 59A is greater than the width of the prior art feeder sprocket 59. This increased width permits sprocket 59A to contact and support shoulder 81 and neck 82, respectively, in the manner described above.

Groove portion 71 can, as illustrated by dashed lines in FIG. 14, include associated sections 71A and 71B that extend outwardly to outer surfaces 67A and 68A, respectively. Groove portion 72 can, as illustrated by dashed lines in FIG. 14, include associated sections 72A and 72B that extend outwardly to outer surfaces 67A and 68A. These associated sections 71A, 71B, 72A, 72B are shaped and dimensioned to contour to shoulder 81 and neck 82 such that portions of shoulder 81 contact and slide over sections 71A and 71B and such that portions of neck 82 contact and slide over sections 72A and 72B while a cartridge 80 slides into and out of groove 60A.

Importantly, surfaces 71, 72, 71A, 71*b*, 72A, 72B more effectively control movement of a cartridge into and out of feeder sprocket 59A, increase the operational life of sprocket 59A, reduce the likelihood that a cartridge will jam while traveling into and out of sprocket 59A, and enable the use of blank rounds, slap rounds, and specialty ammunition without malfunction.

As is illustrated in FIG. 3, control box 11 includes depressible firing buttons 22 and 26, booster motor override control button 23, safety cover 25 over an arming switch (not visible), arming indicator light 24, and handles 27 and 28. When the arming switch is activated, light 24 illuminates, and when either one or both of the firing buttons 22, 26 are then depressed, the gun will fire. When the firing switch(es) is released, the feeder/delinker 20 (ammunition feed device) is disengaged so the ammunition supply is discontinued. The electric motor 12 continues to rotate for about 200 to 400 milliseconds so that the weapon is cleared of remaining ammunition before stopping. The booster motor override control button 23, when depressed, activates the ammunition booster motor on the ammunition magazine (not shown) to facilitate the loading of the weapon. The booster motor pushes the belted ammunition from the ammunition magazine, through the feed chute, and to the weapon where it is inserted in the feeder/delinker 20, readying the weapon for firing.

In one presently preferred embodiment of the invention, only a single access door 100 is provided for the feeder/delinker 20.

FIGS. 4 to 7 illustrate the access door 100 of the invention removed from the feeder/delinker housing 30. Door 100 includes base 120 and a plunger 110. Plunger 110 is pivotally spring loaded on base 120 in slot or opening 230 formed in base 120. Plunger 110 also includes hat or flange member 111 fixedly secured to the top 44 of plunger 110. Wings or lips 112 and 118 of flange member 111 extend outwardly from either side of plunger 110.

Figure 9:
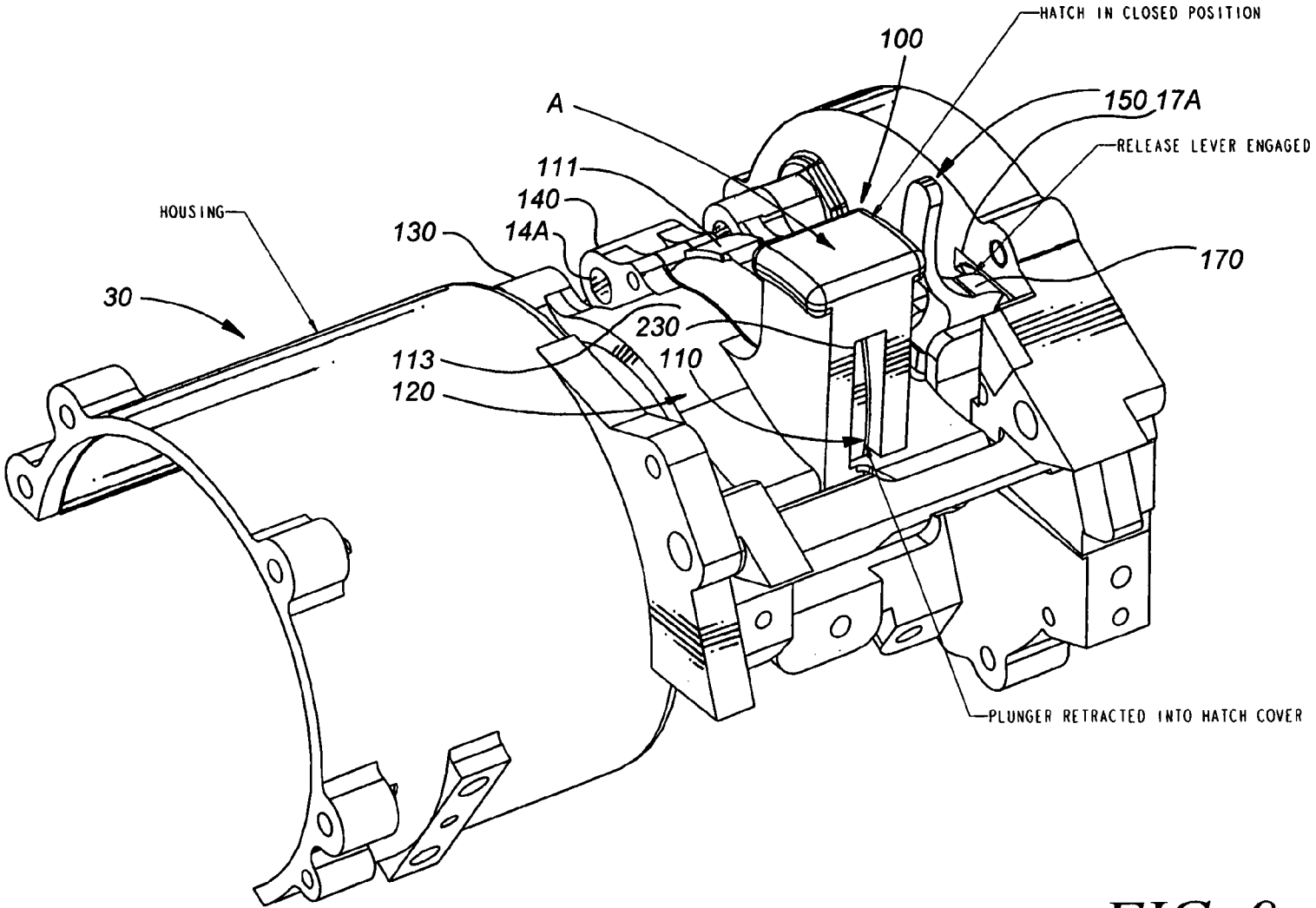
FIG. 9 is a perspective view further illustrating the mode of operation of the access assembly of the invention.
Figure 10:
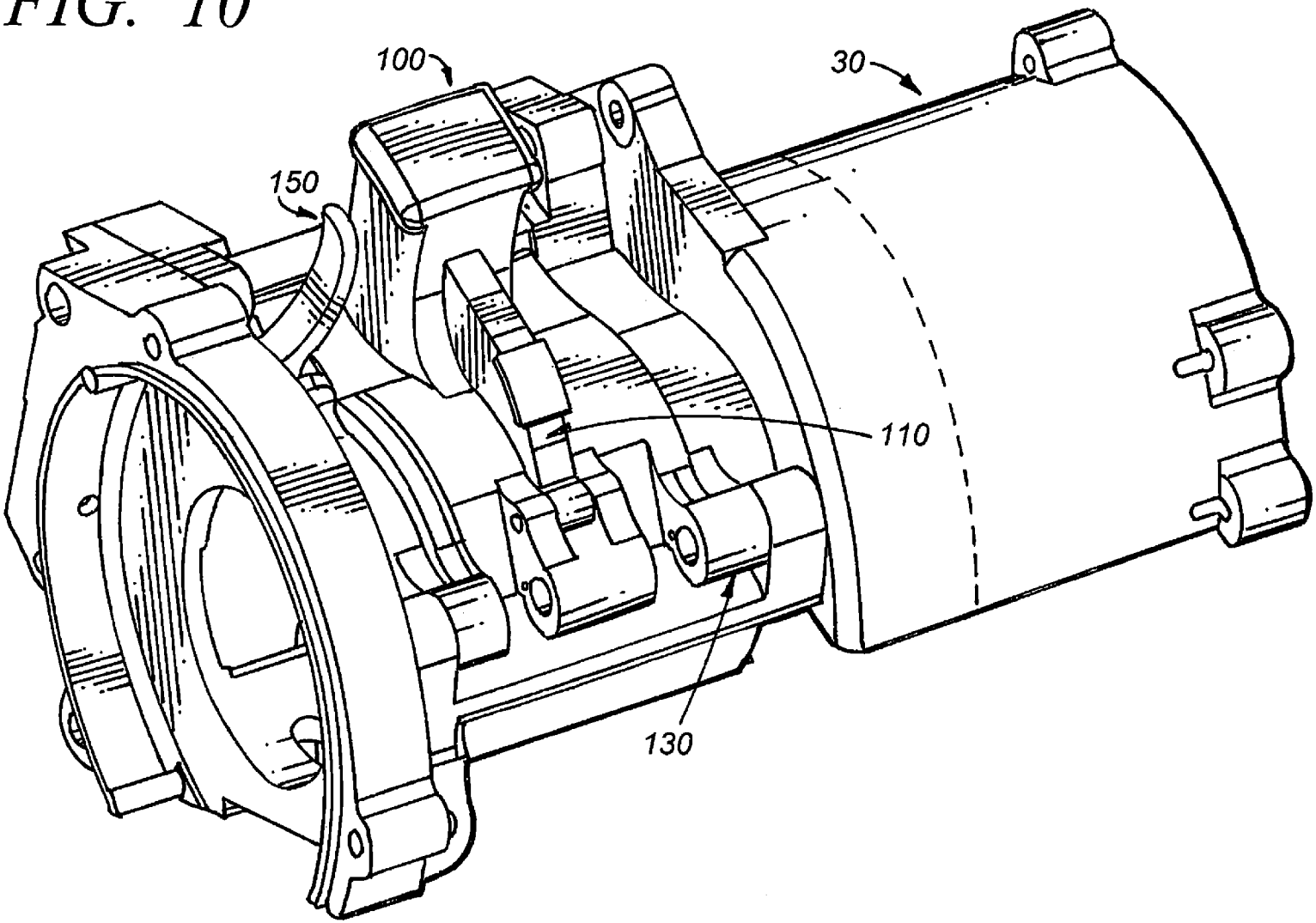
FIG. 10 is a perspective view further illustrating the mode of operation of the access door.
Figure 11:
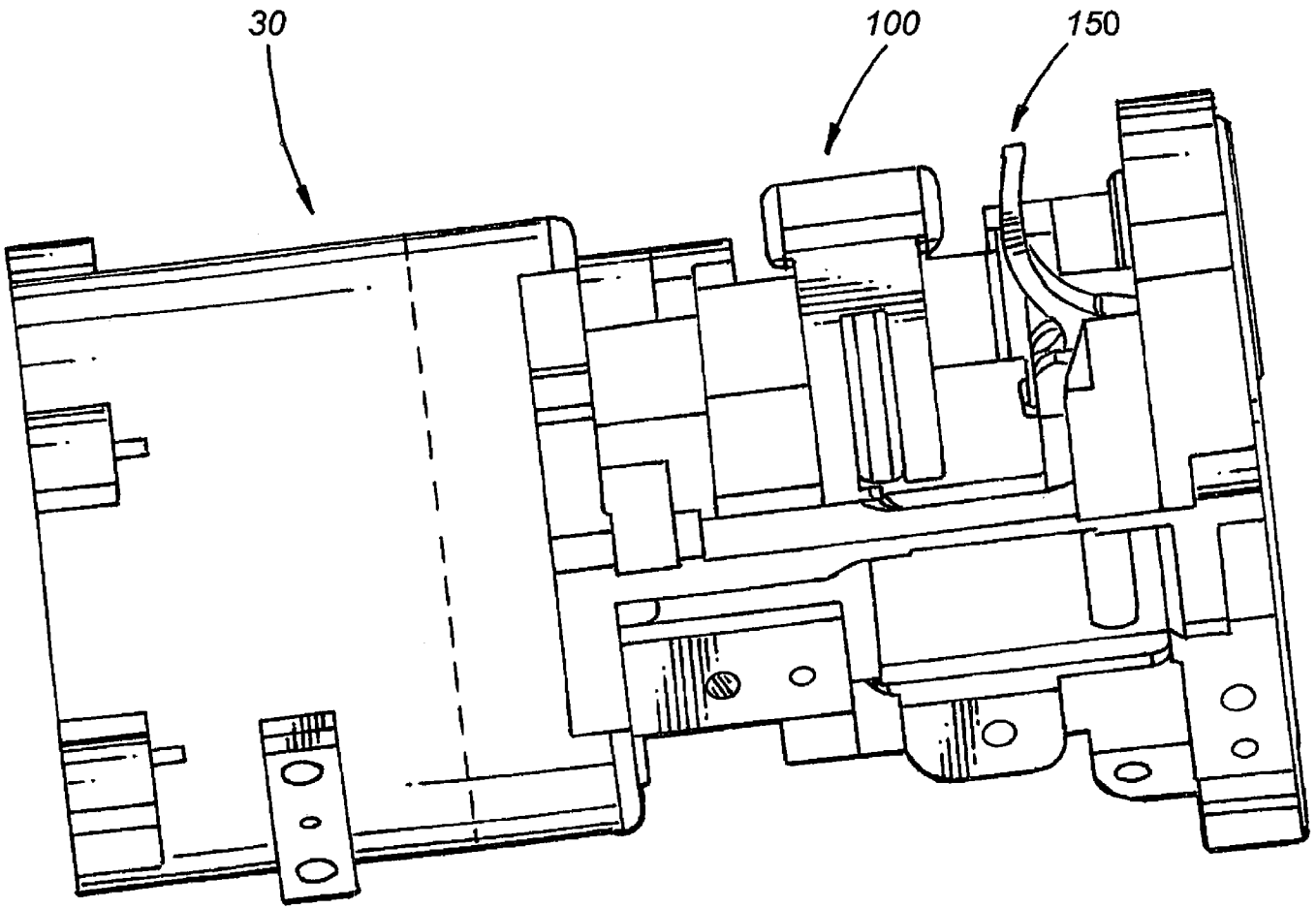
FIG. 11 is a perspective view further illustrating the mode of operation of the access door.

In FIGS. 4 to 7, the plunger 110 is shown in the retracted position in base 120. Plunger 110 is in the retracted position when the access door 100 is in the closed position in housing 30. The access door 100 is shown in the closed position in housing 30 in FIGS. 9 to 11.

Figure 5:
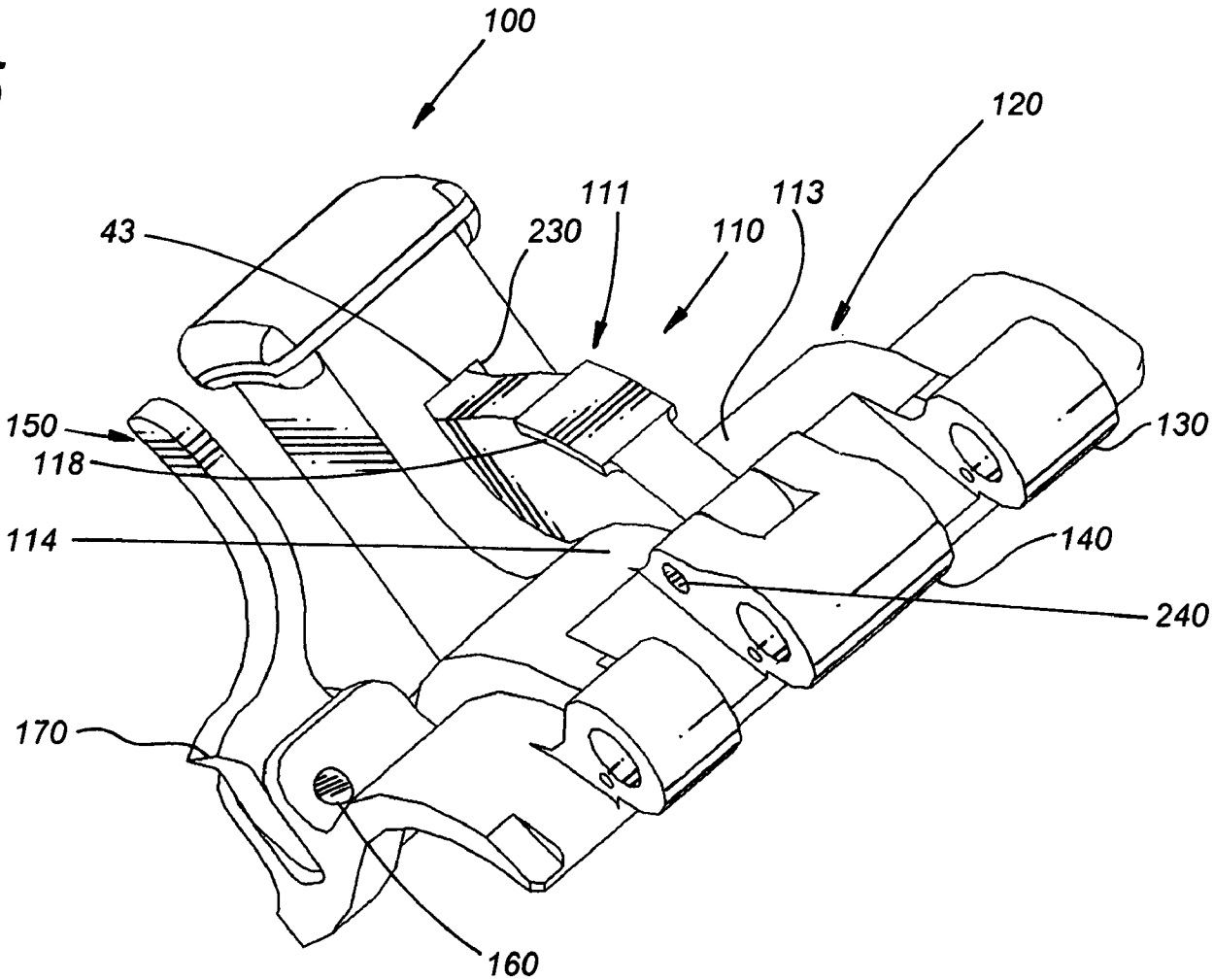
FIG. 5 is a left rear perspective view illustrating the access assembly of the invention.

Plunger 110 includes a bottom surface including portion 200 which bears against a cartridge 40 when door 100 is in the partially closed position, and includes a stop tab 220 with bottom surface 210. Plunger 110 also includes opening 250 formed therethrough (FIG. 7). As shown in FIG. 5, pin 240 extends through opening 250 to pivotally mount plunger 110 on base 120. A control spring 45 (FIGS. 8 and 16) mounted in slot 43 (FIG. 8) and extending between the top 43 of slot 230 and the top 44 of plunger 110 functions to generate a force that causes plunger 110 to pivot about pin 160 and that displaces plunger 110 to the deployed position of FIG. 8 when door 100 is in the partially opened position illustrated in FIG. 8 (or when door 100 is in the completely opened position). When access door 100 is in the partially opened position illustrated in FIG. 8, portion 200 of the bottom surface of plunger 110 contacts cartridge 40; and, continuing to move door 100 in the direction of arrow A from the partially opened position of FIG. 8 to the closed position of FIG. 9 overcomes the forces generated by the control spring 45, compresses spring 45, and forces slot 230 downwardly over plunger 110 to the position illustrated in FIGS. 9 to 11 and 4 to 6.

Release lever 150 is also pivotally spring loaded on base 120 and includes tooth or lip 170. Pin 160 extends through aperture 16A (FIG. 8) and through lever 150 to pivotally mount lever 150 on base 120. When the access door 100 is in the closed position illustrated in FIG. 9, lip 170 engages opening 17A and prevents the access door 100 from opening.

FIG. 7 is an exploded view of the access door 100 illustrating plunger 110 removed from base 120.

Figure 8:
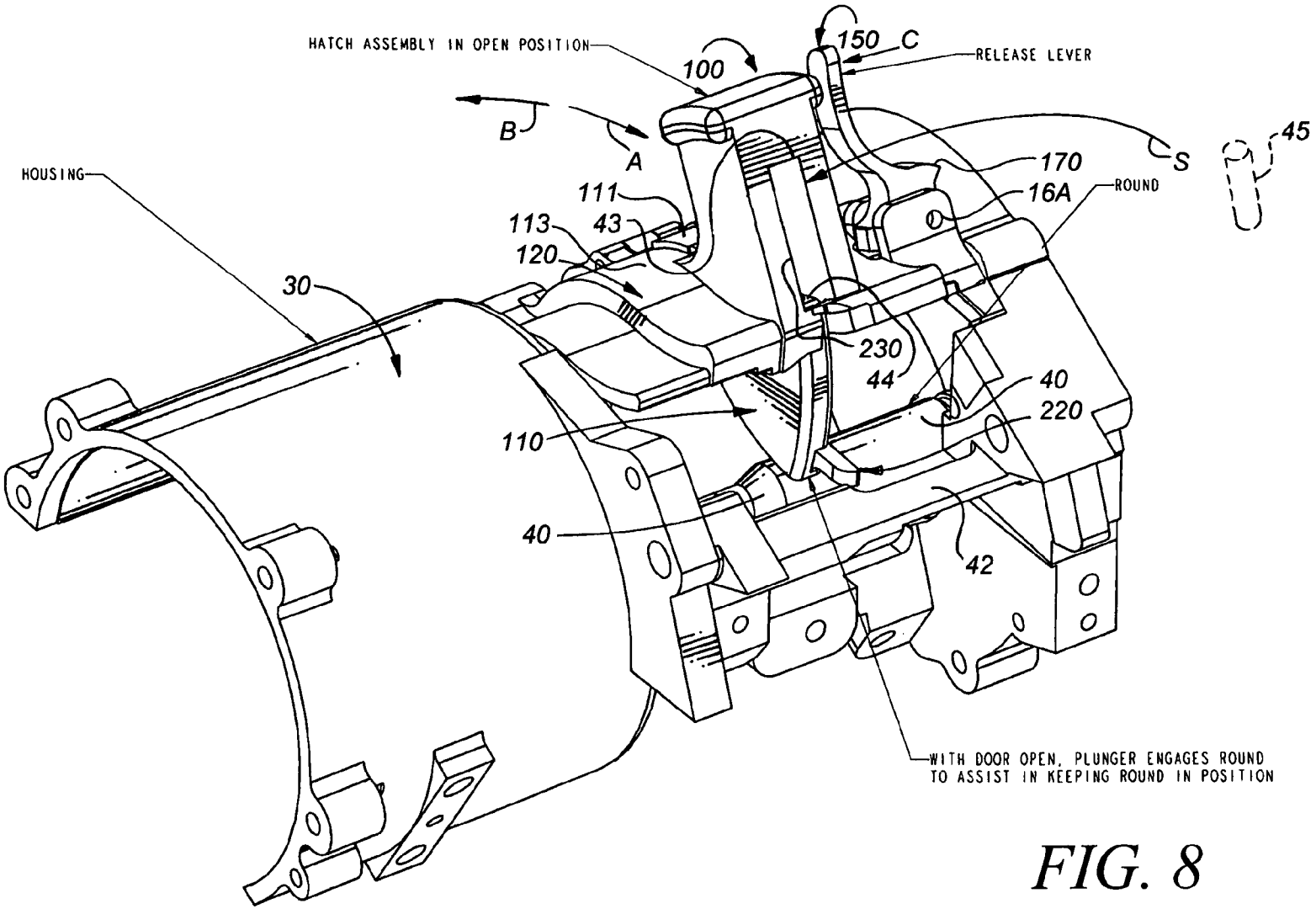
FIG. 8 is a perspective view illustrating the mode of operation of the access assembly of the invention.

Door 100 can be opened in the direction of arrow B (FIG. 8) past the position of door 100 illustrated in FIG. 8 to a completely opened position to allow greater access to the interior of the feeder/delinker so a user can position a cartridge 40 in the interior of the feeder/delinker. The degree to which spring 45 can displace plunger 110 outwardly from slot 230 is controlled by flange member 111. After spring 45 outwardly displaces pluner 110 from slot 230 a selected distance, wings 112 and 188 contact fixed top portions 113 and 114 (FIG. 6), respectively, of the feeder/delinker housing and prevent any further movement of plunger 110 in the direction of arrow A (FIG. 8). In particular, FIG. 8 illustrates door 100 in a partially opened position in which portion 200 of the bottom of plunger 110 contacts a cartridge when plunger 110 is outwardly displaced by spring 45 from slot 230 to the greatest extent possible, i.e., as can be seen in FIG. 8 a wing of flange member 111 contacts top portion 113 of the feeder/delinker housing. And, as noted, when the wings 112, 118 of flange member 111 contact to portions 113 and 144, further outward displacement from slot 230 by spring 45 of plunger 110 is prevented.

When door 100 is in the completely open position, portion 200 of the bottom surface of plunger 110 is spaced apart from, above, and not contacting a cartridge 40 when the cartridge 40 is in the feeder/delinker in the position illustrated in FIG. 8.

When door 100 is moved from the completely open position in the direction of arrow A in FIG. 8 to the partially opened position of FIG. 8, plunger 110 moves simultaneously with door 100 in the same direction of travel as door 100. When door 100 reaches the partially open position of FIG. 8, portion 200 of the bottom surface of plunger contacts a cartridge 40 that is in the feeder/delinker in the position illustrated in FIG. 8.

Once door 100 is in the partially closed position of FIG. 8, portion 200 of the bottom surface of plunger 110 bears against cartridge 40. Continuing to close door 100 in the direction of arrow A compresses spring 45 and forces slot 230 downwardly over plunger 110 to the position illustrated in FIG. 9.

Figure 16:
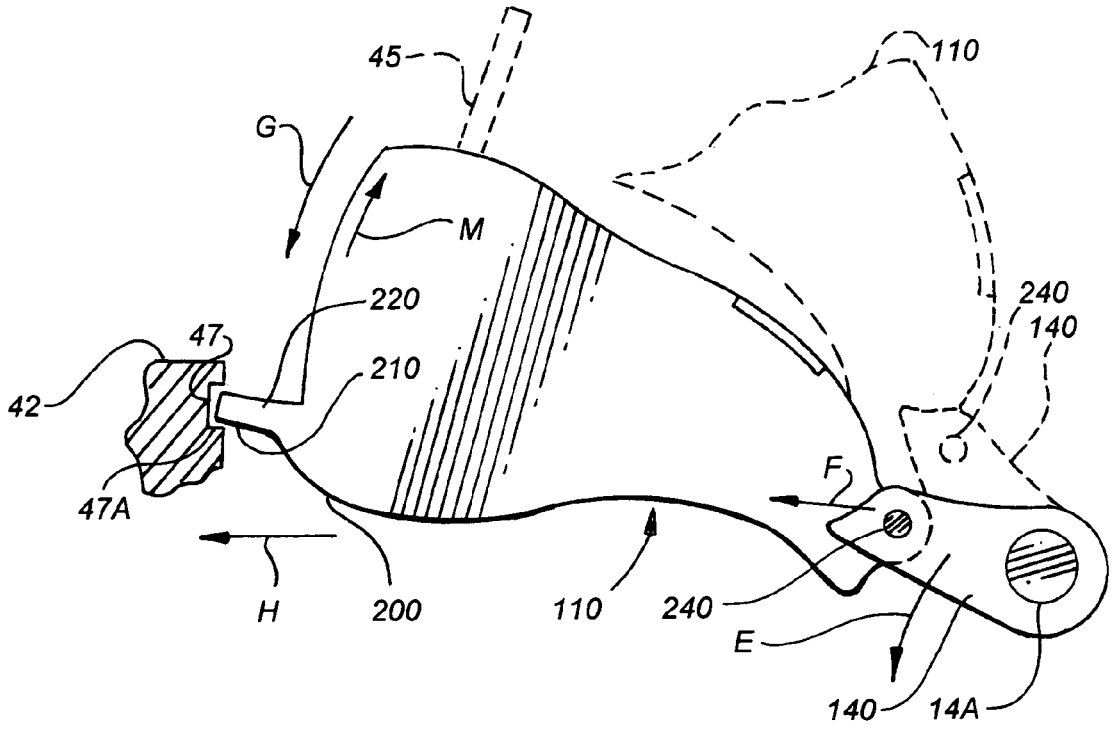
FIG. 16 is a side view of a portion of the improved access hatch door of the invention illustrating the mode of operation thereof.

In FIG. 16, the position of plunger 110 when door 100 is fully open is illustrated in ghost outline. A pocket or opening 47 is formed in the feeder/delinker housing below ledge 42 (FIG. 8). As door 100 is moved in the direction of arrow A (FIG. 8) to the partially closed position of FIG. 8 and thence to the fully closed position of FIG. 9, the hinge 140 of door 100 pivots about pin 14A in the direction of arrow G. As hinge 140 pivots about pin 14A, plunger 110 moves downward in the direction of arrow G. As noted, while door 100 moves downwardly in the direction of arrow A, spring 45 has displaced plunger 110 outwardly to the fullest possible extend such that wings 112 and 118 contact the surfaces 113 and 114 of the feeder/delinker housing. Consequently, while door 100 is moved from a fully open position to the partially closed position of FIG. 8, door 100 and plunger 110 move simultaneously, with plunger 110 moving in unison with door 100. After, however, door 100 reaches the partially closed position of FIG. 8 and is continued to be moved downwardly in the direction of arrow A to the fully closed position of FIG. 9, the bottom of plunger 110 continues to bear against cartridge 40 and cartridge 40 prevents downward movement of plunger 110. However, when door 100—and therefore hinge 140—is moved from the partially closed to the fully closed position, hinge 140 (FIG. 16) continues to pivot downwardly in the direction of arrow E, which has the effect of displacing pin 240 (about which one end of plunger 110 pivots freely) in the direction of arrow F and stop tab 220 in the direction of arrow H such that the distal end of stop tab 220 is displaced into and captured by opening 47 to secure plunger in place when door 100 is in the closed position. When door 100 is subsequently opened, hinge 140 pivots upwardly in a direction opposite that of arrow E and moves pin 240 away from opening 47 in a direction opposite that of arrow H to withdraw the distal end of stop tab 220 from opening 47 so that plunger 110 is free to be upwardly displaced in a direction opposite that of arrow G.

It is important to note that when door 100 is nearly closed, the portion 200 of the bottom of plunger 110 that is contacting a cartridge 40 in the feeder/delinker is raised slightly to provide clearance between the cartridge 40 and the bottom of the plunger. This clearance can vary as desired, but presently is about five thousandths of an inch. Pocket 47 and stop tab 220 are configured and shaped and dimensioned such that as door 100 is nearly closed, the bottom surface 210 of stop tab 220 slides over the bottom 47A of pocket 47 to displace plunger 110 a short distance upwardly in the direction of arrow M so that plunger 110 no longer touches cartridge 40 and does not touch any portion of the belt of ammunition being fed into the feeder/delinker 20.

When door 100 is in the closed position, lip 170 of lever 150 is engaged in aperture 17A to lock door 100 in the closed position.

Figure 6:
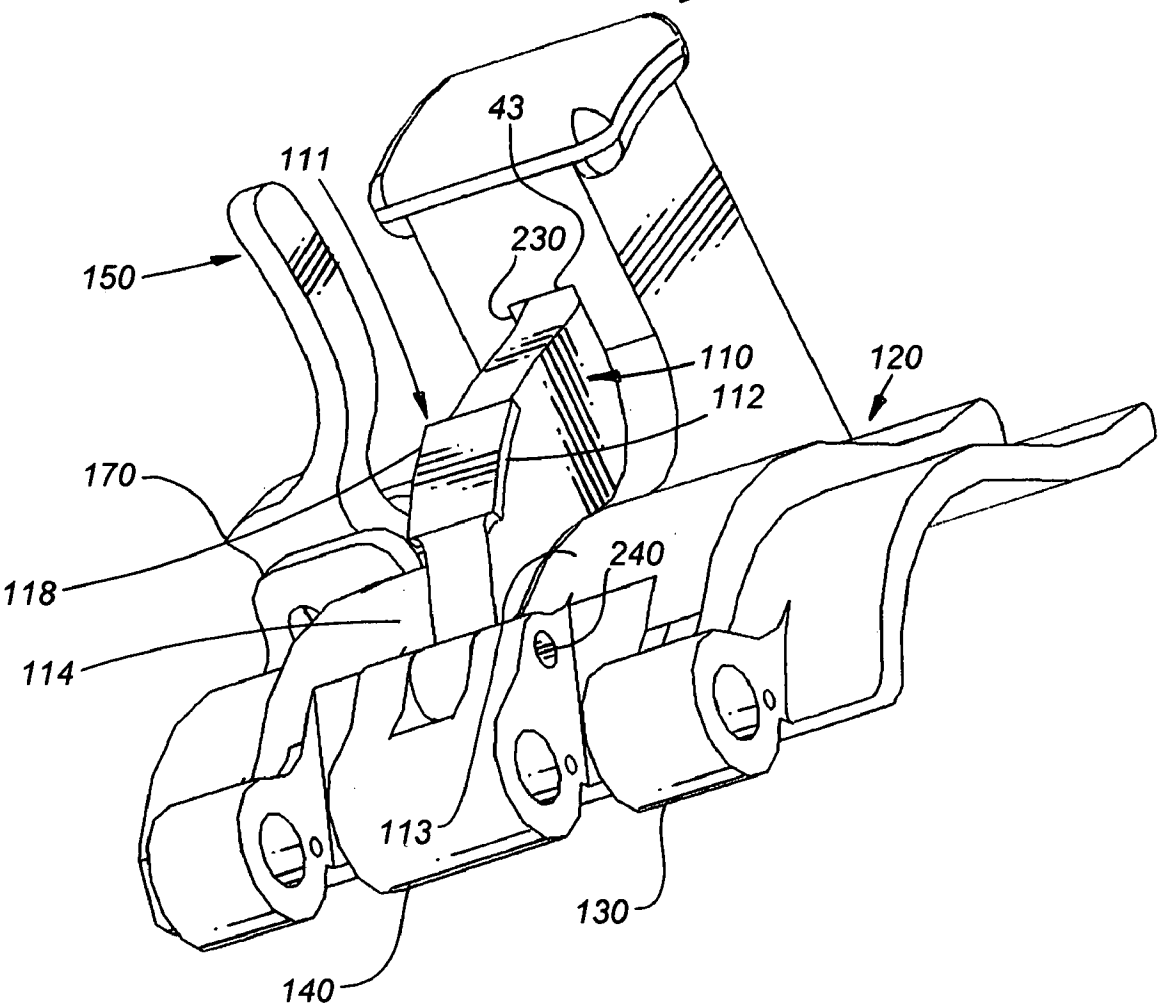
FIG. 6 is a right rear perspective view illustrating the access assembly of the invention.
Figure 7:
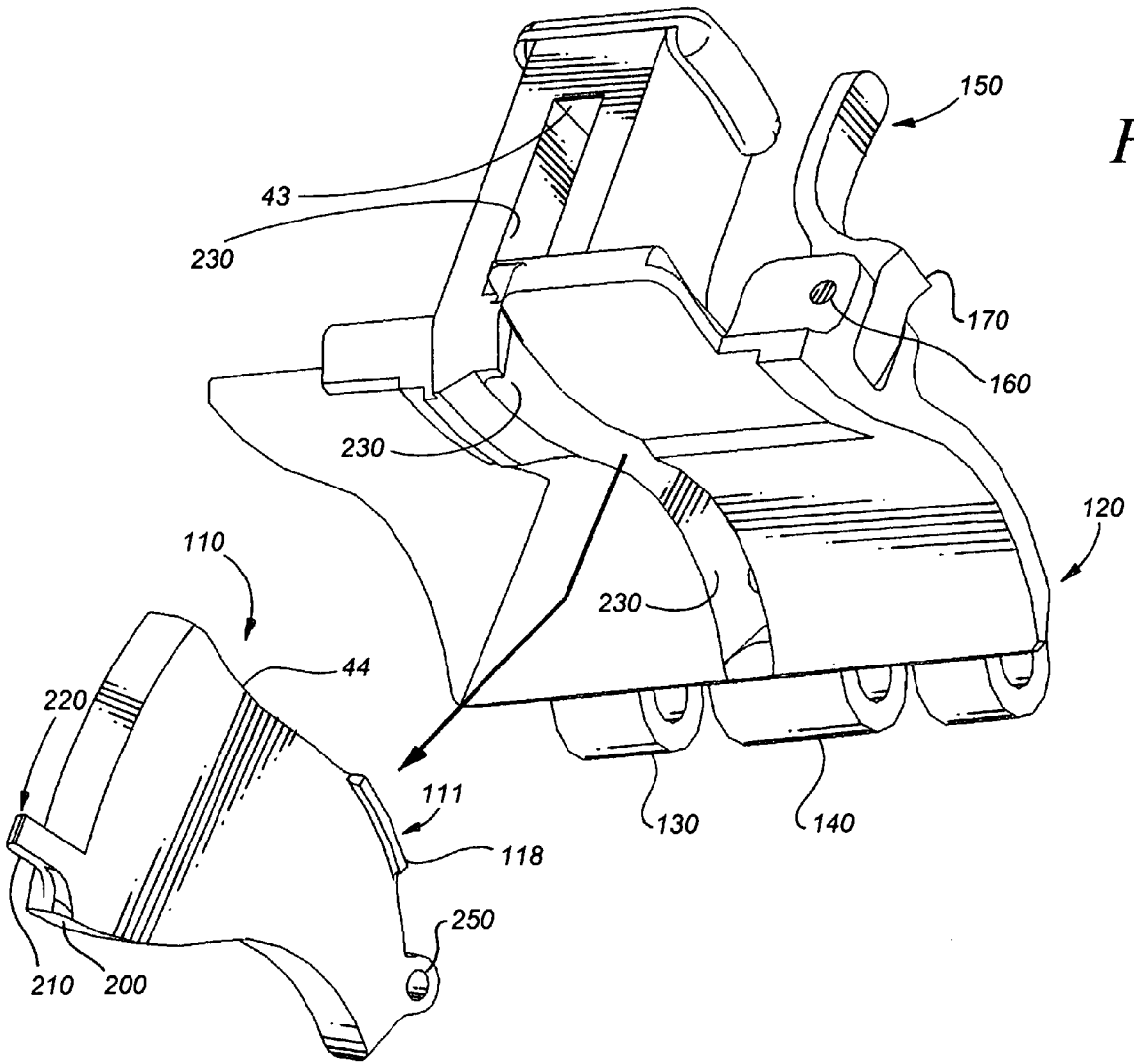
FIG. 7 is a bottom exploded perspective view illustrating the access assembly of the invention.

In use, a user manually displaces lever 150 inwardly in the direction of arrow C to disengage lip 170 from opening 17A and then opens door 100 in the direction of arrow B from the closed position of FIG. 6 to a completely open position to allow access to the interior of the feeder/delinker. The user positions a cartridge(s) 40 in the interior of the feeder/delinker in the position illustrated in FIG. 8, places with one hand a finger(s) on cartridge 40 to hold the cartridge in place, moves with the other hand door 100 from the completely open position to the partially open position of FIG. 8 such that the portion 200 of the bottom surface of plunger 110 rests on and holds cartridge in place in the manner illustrated in FIG. 8, removes his finger(s) from cartridge 40, and then moves door 100 from the partially opened position of FIG. 8 to the closed position of FIG. 9 such that lip 170 snaps into opening 17A and holds door 100 in the closed position. The door 100—plunger 110 construction of the invention typically reduces loading time by about 300% to 400% in comparison to prior art door systems which utilize a side-by-side pair of access doors.

Figure 18:
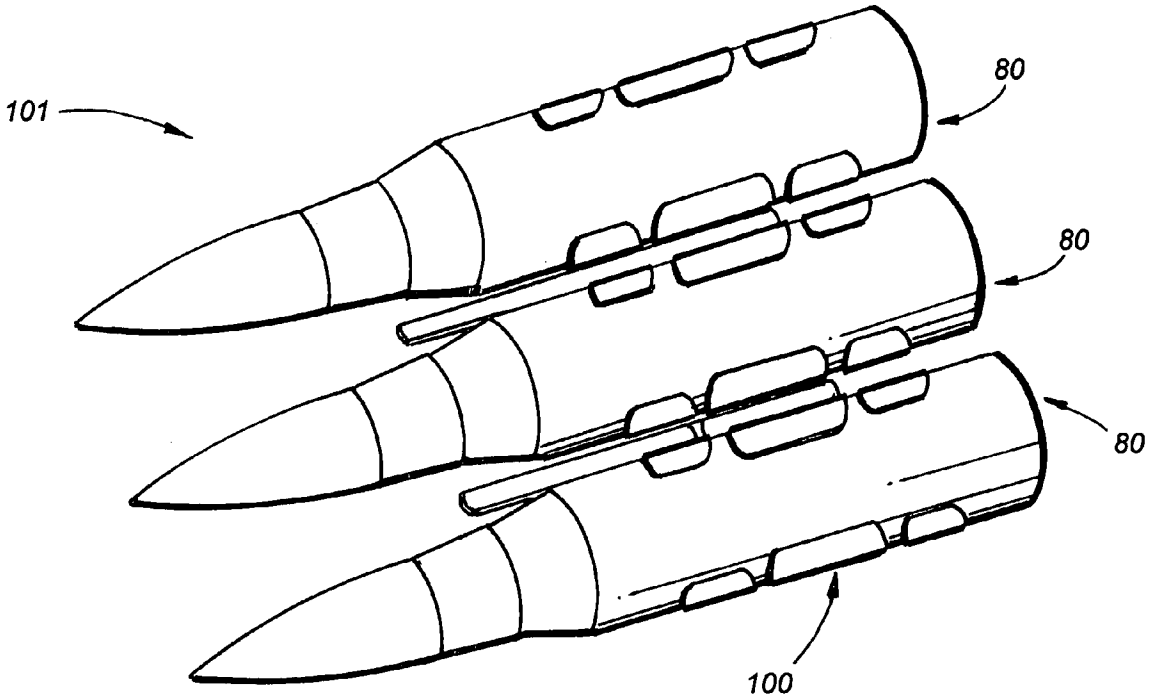
FIG. 18 PRIOR ART

FIG. 18 illustrates a belt of ammunition 101 comprising cartridges 80 interconnected by a linkage system 100.

Having described the invention and presently preferred embodiments and the best modes thereof in such terms as to enable one of skill in the art to make and use the invention, I claim:

1. A gatling gun including (a) a barrel assembly including a plurality of circumferentially mounted gun barrels;

(b) a motor to rotate the barrel assembly;

(c) a feeder/delinker to receive a belt of linked cartridges, separate cartridges from the belt, and feed the cartridges for firing, said feeder/delinker including (i) a feeder/delinker housing, (ii) a shaft mounted in said feeder/delinker housing, (iii) a drive gear mounted on said shaft, operatively associated with said motor, and rotationally coupled to said shaft and to the plurality of gun barrels, (iv) a push rod guide housing mounted in said feeder/delinker housing on said shaft and including a plurality of spaced apart, parallel, longitudinal guide slots each parallel to said gun barrels, (v) a plurality of push rods each slidably mounted in one of said longitudinal guide slots in said push rod guide housing, (vi) a slide channel apparatus rotationally coupled to the drive gear to oscillate each of said plurality of push rods forwardly and rearwardly, (vii) a secondary cartridge holding construct mounted on said shaft forwardly of said push rod guide housing, and including a plurality of grooves each aligned with one of said guide slots in said push rod guide housing, (viii) a secondary cartridge stripping construct mounted on said shaft forwardly of said secondary cartridge holding constructed, including a plurality of grooves each aligned with one of said guide slots in said push rod guide housing, and shaped and dimensioned to receive and prevent longitudinal movement of a cartridge link such that when a linked cartridge positioned in one of said holding construct grooves and one of said stripping construct grooves is displaced longitudinally by an associated push rod, said push rod being moved longitudinally by said slide channel apparatus, said stripping construct retains the cartridge link and permits the cartridge to be freed from the link, (ix) a feeder sprocket to receive cartridges from said stripper construct after the cartridges have been freed from cartridge links, said cartridges each including a casing, a tapered, conically shaped shoulder, and a tapered, conically shaped neck, said sprocket including a plurality of grooves each aligned with one of said guide slots in said push rod guide housing, shaped and dimensioned to slidably receive and dispense a cartridge, including tapered guide surfaces contoured to conform substantially to at least a portion of each of said tapered, conically shaped shoulder, said tapered, conically shaped neck, and said casing; and, (d) a single access door mounted on said feeder/delinker housing and movable between at least two operative positions, (i) a first closed operative position, and (ii) a second open operative position, said access door including a plunger to contact and secure a linked cartridge in said holding and stripping constructs when said access door is in said second open position, said plunger movable between at least two operative positions, (i) a first operative position with a portion of said plunger stored in said access door, and (ii) a second operative position with said portion of said plunger deployed from said access door.

2. A gatling gun including (a) a barrel assembly including a plurality of circumferentially mounted gun barrels;

(b) a motor to rotate the barrel assembly;

(c) a feeder/delinker to receive a belt of linked cartridges, separate cartridges from the belt, and feed the cartridges for firing, said feeder/delinker including (i) a feeder/delinker housing, (ii) a shaft mounted in said feeder/delinker housing, (iii) a drive gear mounted on said shaft, operatively associated with said motor, and rotationally coupled to said shaft and to the plurality of gun barrels, (iv) a push rod guide housing mounted in said feeder/delinker housing on said shaft and including a plurality of spaced apart, parallel, longitudinal guide slots each parallel to said gun barrels, (v) a plurality of push rods each slidably mounted in one of said longitudinal guide slots in said push rod guide housing, (vi) a slide channel apparatus rotationally coupled to the drive gear to oscillate each of said plurality of push rods forwardly and rearwardly, (vii) a secondary cartridge holding construct mounted on said shaft forwardly of said push rod guide housing, and including a plurality of grooves each aligned with one of said guide slots in said push rod guide housing, (viii) a secondary cartridge stripping construct mounted on said shaft forwardly of said secondary cartridge holding constructed, including a plurality of grooves each aligned with one of said guide slots in said push rod guide housing, and shaped and dimensioned to receive and prevent longitudinal movement of a cartridge link such that when a linked cartridge positioned in one of said holding constructed grooves and one of said stripping construct grooves is displaced longitudinally by an associated push rod, said push rod being moved longitudinally by said slide channel apparatus, said stripping construct retains the cartridge link and permits the cartridge to be freed from the link, (ix) a feeder sprocket to receive cartridges from said stripper construct after the cartridges have been freed from cartridge links, said cartridges each including a casing, a tapered, conically shaped shoulder, and a tapered, conically shaped neck, said sprocket including a plurality of grooves each aligned with one of said guide slots in said push rod guidehousing, shaped and dimensioned to slidably receive and dispense a cartridge, including tapered guide surfaces contoured to conform substantially to at least a portion of each of said tapered, conically shaped shoulder, said tapered, conically shaped neck, and said casing.

3. A gatling gun including (a) a barrel assembly including a plurality of circumferentially mounted gun barrels;

(b) a motor to rotate the barrel assembly;

(c) a feeder/delinker to receive a belt of linked cartridges, separate cartridges from the belt, and feed the cartridges for firing, said feeder/delinker including (i) a feeder/delinker housing, (ii) a shaft mounted in said feeder/delinker housing, (iii) a drive gear mounted on said shaft, operatively associated with said motor, and rotationally coupled to said shaft and to the plurality of gun barrels, (iv) a push rod guide housing mounted in said feeder/delinker housing on said shaft and including a plurality of spaced apart, parallel, longitudinal guide slots each parallel to said gun barrels, (v) a plurality of push rods each slidably mounted in one of said longitudinal guide slots in said push rod guide housing, (vi) a slide channel apparatus rotationally coupled to the drive gear to oscillate each of said plurality of push rods forwardly and rearwardly, (vii) a secondary cartridge holding construct mounted on said shaft forwardly of said push rod guide housing, and including a plurality of grooves each aligned with one of said guide slots in said push rod guide housing, (viii) a secondary cartridge stripping construct mounted on said shaft forwardly of said secondary cartridge holding constructed, including a plurality of grooves each aligned with one of said guide slots in said push rod guide housing, and shaped and dimensioned to receive and prevent longitudinal movement of a cartridge link such that when a linked cartridge positioned in one of said holding constructed grooves and one of said stripping construct grooves is displaced longitudinally by an associated push rod, said push rod being moved longitudinally by said slide channel apparatus, said stripping construct retains the cartridge link and permits the cartridge to be freed from the link, (ix) a feeder sprocket to receive cartridges from said stripper construct after the cartridges have been freed from cartridge links; and, (d) a single access door mounted on said feeder/delinker housing and movable between at least two operative positions, (i) a first closed operative position, and (ii) a second open operative position, said access door including a plunger to contact and secure a linked cartridge in said holding and stripping constructs when said access door is in said second open position, said plunger movable between at least two operative positions, (i) a first operative position with a portion of said plunger stored in said access door, and (ii) a second operative position with said portion of said plunger deployed from said access door.

* * * * *